US006560829B1

(12) United States Patent
Chen

(10) Patent No.: US 6,560,829 B1
(45) Date of Patent: May 13, 2003

(54) PULL TAB OF A ZIPPER

(76) Inventor: Shou Mao Chen, 344, Sec. 1, Chung Shan Rd., Tah-Cha Township, Taichung Hsien (TW)

( * ) Notice: Subject to any disclaimer, the term of this patent is extended or adjusted under 35 U.S.C. 154(b) by 0 days.

(21) Appl. No.: 10/071,305

(22) Filed: Feb. 11, 2002

(51) Int. Cl.[7] ..... A44B 1/04
(52) U.S. Cl. ..... 24/429
(58) Field of Search ..... 24/429–431

(56) References Cited

U.S. PATENT DOCUMENTS 2,221,759 A * 11/1940 Erand ..... 24/431
5,105,512 A * 4/1992 Aussedat ..... 24/429
5,187,841 A * 2/1993 Takemura et al. ..... 24/429
5,535,491 A * 7/1996 Allport ..... 24/429
5,771,546 A * 6/1998 Minato ..... 24/429
5,860,192 A * 1/1999 Chung ..... 24/429
6,035,497 A * 3/2000 Jackson ..... 24/429
6,098,253 A * 8/2000 Nishida et al. ..... 24/429

FOREIGN PATENT DOCUMENTS

JP 2000262308 A * 9/2000 ..... A44B/19/26

* cited by examiner

*Primary Examiner*—James R. Brittain
(74) *Attorney, Agent, or Firm*—Harrison & Egbert

(57) ABSTRACT

A zipper pull tab includes a main body and a fastening member of a pliable and tough material. The main body is provided at one end with a retaining projection and a fixation hole. The fastening member is fastened to the main body and is provided at the free end with a retaining slot. The fastening member is used to fasten a zipper slide such that the free end of the fastening member is put through the zipper slide, and such that the fastening member is bent toward the main body to enable the retaining slot of the fastening member to retain therein the retaining projection of the main body, thereby resulting in formation of a loop by the fastening member.

3 Claims, 7 Drawing Sheets

PULL TAB OF A ZIPPER

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates generally to a zipper, and more particularly to a pull tab of the zipper.

BACKGROUND OF THE INVENTION

As illustrated in FIGS. 1–3, a prior art zipper 10 comprises a chain 11, a slide 12, and a pull tab 13. The pull tab 13 is fastened at one end with the slide 12 by a fastening piece 121. As the pull tab 13 is pulled, the slide 12 moves to join or separate two adjoining edges of the chain 11. The fastening piece 121 is vulnerable to damage, as shown in FIG. 2. The damage may be caused by impact or a prolonged use of the zipper 10. In addition, the pull tab 13 is provided at one end with a fastening ring 131 for fastening the pull tab 13 with the fastening piece 121. The fastening ring 131 of the pull tab 13 is also vulnerable to damage, as shown in FIG. 3. It is readily apparent that the prior art zipper 10 has an inherent structural deficiency, which accounts for its short service life span. In addition, the prior art zipper 10 is often used in a luggage such that the slide 12 and the pull tab 13 are provided with a pigment coating in harmony with that of the luggage. The pigment coating of the slide 12 is susceptible to being scratched by the pull tab 13.

BRIEF SUMMARY OF THE INVENTION

The primary objective of the present invention is to provide a zipper with a pull tab which is free of the deficiencies of the prior art zipper described above.

The foregoing objective of the present invention is attained by a zipper pull tab comprising a main body and a fastening member which is pliable. The main body is provided at the fastening end with a retaining projection. The fastening member is provided at the free end with a retaining slot engageable with the retaining projection of the main body. In light of pliability of the fastening member, the fastening member is bent to enable the retaining slot to retain therein the retaining projection, thereby forming a receiving space in which the fastening end of a zipper slide is received.

The features and the advantages of the present invention will be more readily understood upon a thoughtful deliberation of the following detailed description of the present invention with reference to the accompanying drawings.

DETAILED DESCRIPTION OF THE INVENTION

Figure 1:
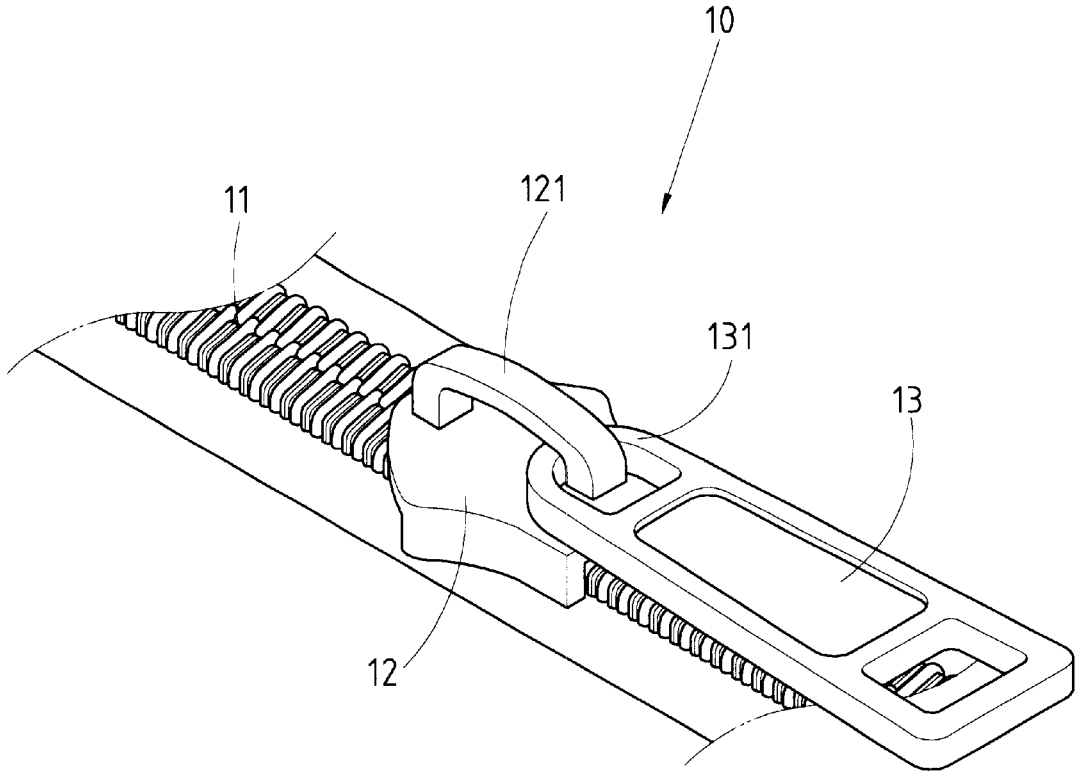
FIG.1 PRIOR ART
FIG. 1 shows a perspective view of a zipper pull tab of the prior art.
Figure 2:
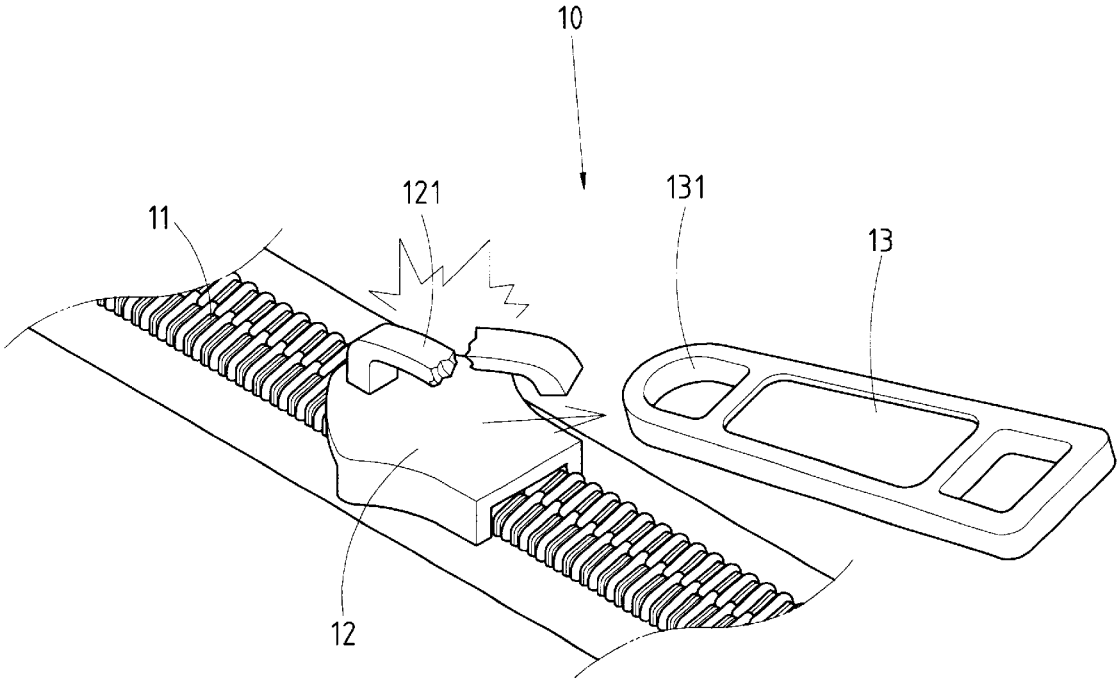
FIG.2 PRIOR ART
FIGS. 2 and 3 show schematic views of the prior art zipper pull tab in use.
Figure 3:
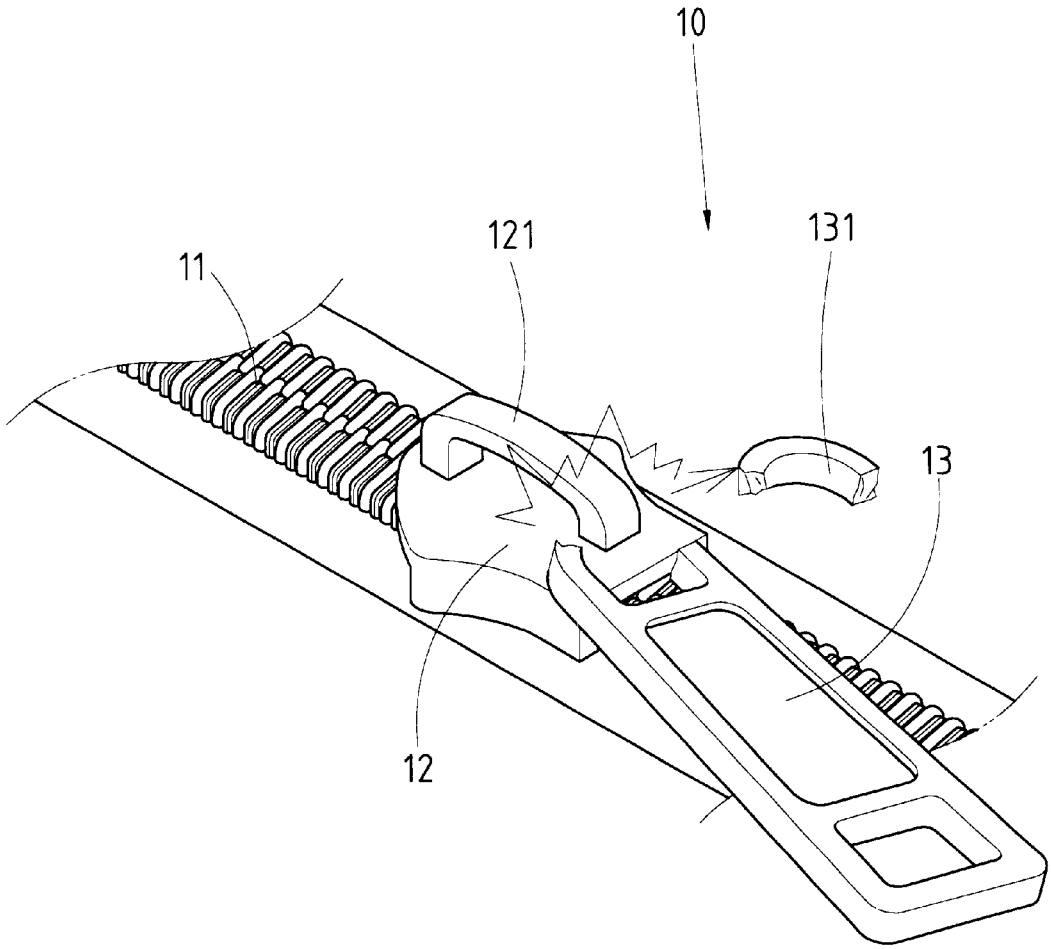
FIG.3 PRIOR ART
Figure 4:
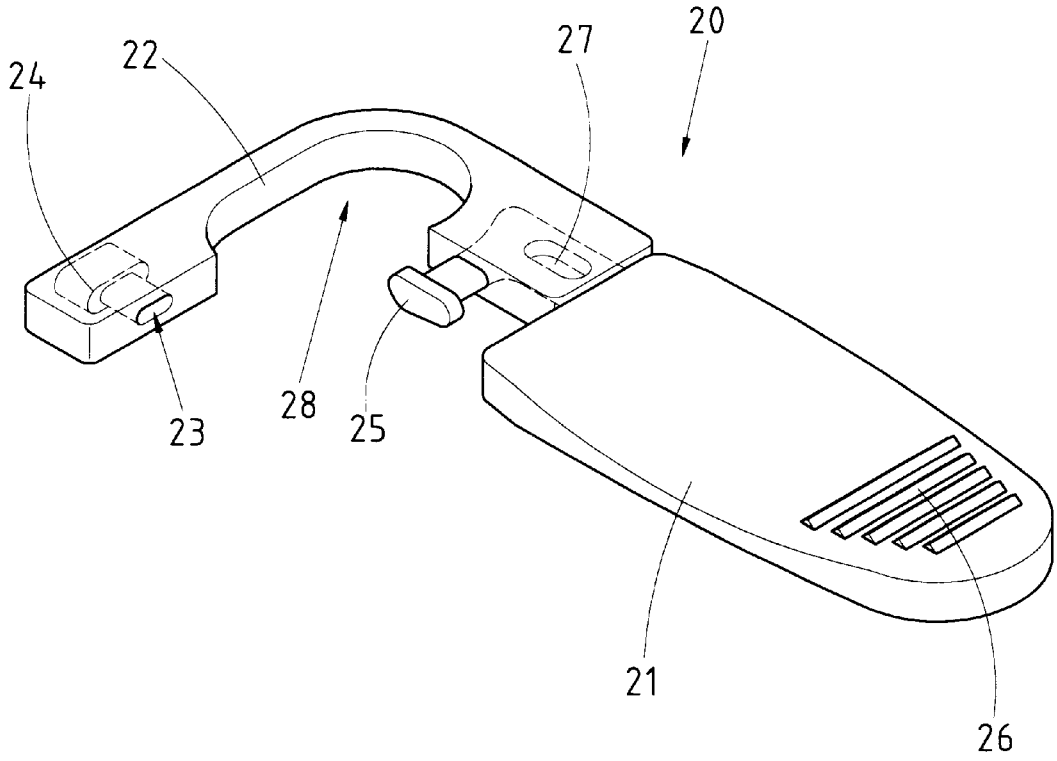
FIG. 4 shows a perspective view of the present invention.
Figure 5:
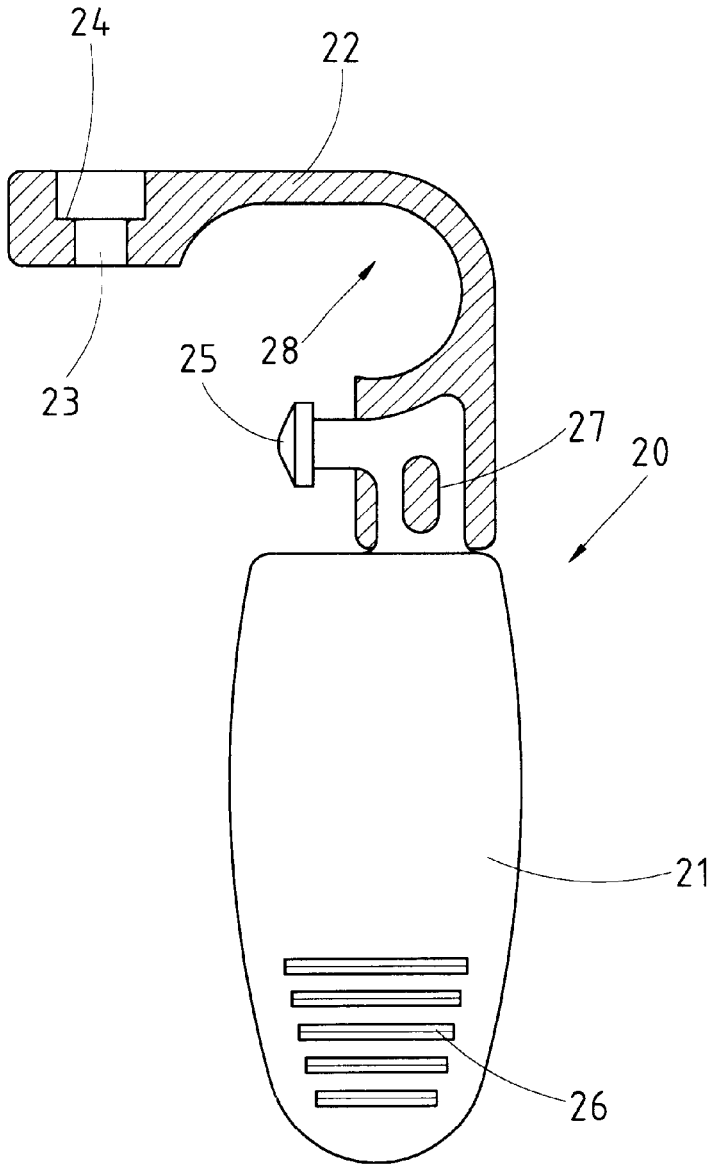
FIG. 5 shows a partial sectional view of the present invention.
Figure 6:
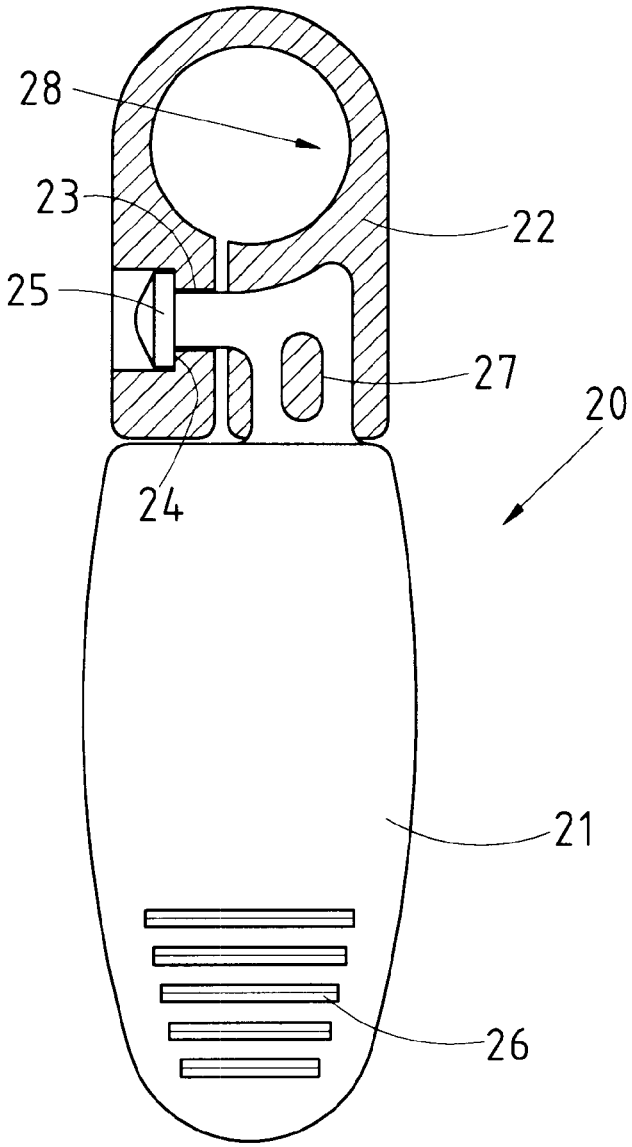
FIG. 6 shows a partial sectional view of the present invention at work.
Figure 7:
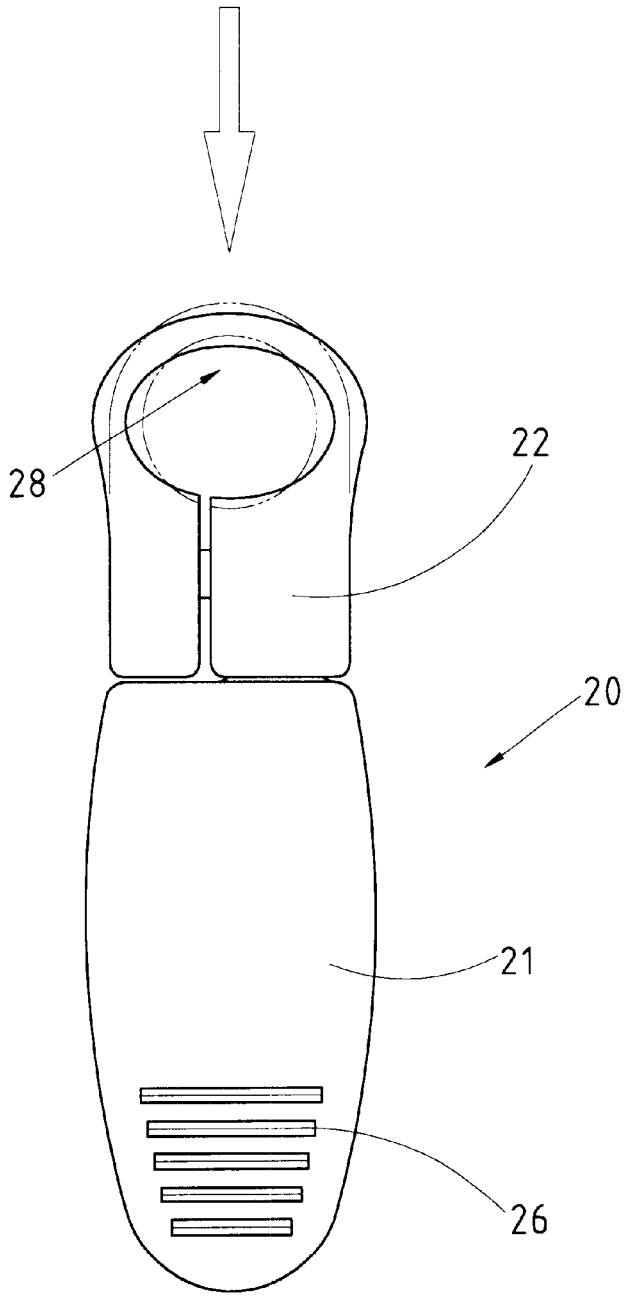
FIG. 7 shows a schematic view of the present invention in action.

As shown in FIGS. 4–7, a zipper pull tab 20 of the present invention comprises a main body 21 and a fastening member 22 which is pliable in nature and is fastened to one end of the main body 21.

The main body 21 is provided at one end with a retaining projection 25 and a fixation hole 27. The main body 21 is preferably provided in the surface thereof with a plurality of skidproof ribs 26 to enhance frictional contact between the main body 21 and the fingers.

The fastening member 22 is made separately and then joined with the main body 21 such that one end of the fastening member 22 is fixed in the fixation hole 27 of the main body 21. The fastening member 22 is provided at the free end with a retaining slot 23 engageable with the retaining projection 25 of the main body 21. The retaining slot 23 is preferably provided with an arresting wall 24 for arresting the retaining projection 25 so as to prevent the retaining projection 25 from slipping out of the retaining slot 23.

In light of pliability of the fastening member 22, the fastening member 22 can be bent toward the main body 21, so as to enable the retaining slot 33 of the fastening member 22 to retain therein the retaining projection 25 of the main body 21, thereby resulting in formation of a receiving space 28 in which the fastening portion of a slide (not shown in the drawings) is held.

It must be noted here that the fastening member 22 is made of a pliable and tough material.

The present invention described above is to be regarded in all respects as being illustrative and nonrestrictive. Accordingly, the present invention may be embodied in other specific forms without deviating from the spirit thereof. The present invention is therefore to be limited only by the scope of the following claims.

I claim:

1. A pull tab of a zipper comprising:

a main body comprised of, at one end, a retaining projection and a fixation hole; and a fastening member comprised of a material having a pliability and a toughness, said fastening member being fastened at one end to said main body such that said one end of said fastening member is fixed with said fixation hole of said main body, said fastening member being provided at a free end thereof with a retaining slot engageable with said retaining projection of said main body and comprising an arresting wall whereby said fastening member is used to fasten a slide in such a fashion that said free end of said fastening member is put through a fastening portion of the slide, and such that said fastening member is then bent toward said one end of said main body so as to enable said retaining projection of said main body to be retained in said retaining slot of said fastening member.

2. The pull tab as defined in claim 1, wherein said main body is comprised of, in a surface thereof, a plurality of skidproof ribs.

3. The pull tab as defined in claim 1, wherein said fastening member forms a loop when said retaining slot of said fastening member is joined with said retaining projection of said main body.

* * * * *